US011293321B2

(12) United States Patent
Alig et al.

(10) Patent No.: US 11,293,321 B2
(45) **Date of Patent: *Apr. 5, 2022**

(54) METHOD FOR OPERATING A PARTICULATE FILTER IN A VEHICLE, AND PARTICULATE FILTER FOR AN INTERNAL COMBUSTION ENGINE IN A VEHICLE

(71) Applicant: Bayerische Motoren Werke Aktiengesellschaft, Munich (DE)

(72) Inventors: Robert Alig, Germering (DE); Oliver Grabherr, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/959,756

(22) PCT Filed: Feb. 15, 2019

(86) PCT No.: PCT/EP2019/053753
§ 371 (c)(1),
(2) Date: Jul. 2, 2020

(87) PCT Pub. No.: WO2019/170388
PCT Pub. Date: Sep. 12, 2019

(65) Prior Publication Data

US 2020/0362737 A1 Nov. 19, 2020

(30) Foreign Application Priority Data

Mar. 5, 2018 (DE) ..... 10 2018 203 225.4

(51) Int. Cl.
*F01N 3/035* (2006.01)
*F01N 3/022* (2006.01)

(52) U.S. Cl.
CPC ..... *F01N 3/035* (2013.01); *F01N 3/022* (2013.01); *F01N 2330/12* (2013.01); *F01N 2450/04* (2013.01); *F01N 2510/06* (2013.01)

(58) Field of Classification Search
CPC ..... F01N 3/035; F01N 3/022; F01N 2450/04; F01N 2330/12; F01N 2510/06; F01N 2610/10
See application file for complete search history.

(56) References Cited

U.S. PATENT DOCUMENTS

2006/0059899 A1* 3/2006 Bailey ..... F01N 3/2093 60/296
2007/0033912 A1* 2/2007 Furukawa ..... C04B 38/0006 55/523

(Continued)

FOREIGN PATENT DOCUMENTS

CN 106246298 A 12/2016
CN 108691604 A 10/2018

(Continued)

OTHER PUBLICATIONS

Machine Translation of WO 2009106373 A1 (Year: 2009).*

(Continued)

*Primary Examiner* — Brandon D Lee
(74) *Attorney, Agent, or Firm* — Crowell & Moring LLP

(57) ABSTRACT

A method operates a particulate filter through which exhaust gas can flow in a vehicle, in which ash is introduced into a filter body of the particulate filter, wherein at least one ash former or at least one ash component is arranged on at least one carrier material upstream of the filter body in the direction of flow of the exhaust gas.

24 Claims, 5 Drawing Sheets

(56) References Cited

U.S. PATENT DOCUMENTS

| | | | | |
|---|---|---|---|---|
| 2010/0266461 | A1* | 10/2010 | Sappok | B01D 39/2093 422/177 |
| 2016/0363019 | A1 | 12/2016 | Warner et al. | |
| 2018/0298799 | A1* | 10/2018 | Wessels | F01N 13/0097 |
| 2018/0340784 | A1* | 11/2018 | Upadhyay | F01N 9/002 |

FOREIGN PATENT DOCUMENTS

| | | | | |
|---|---|---|---|---|
| DE | 10 2016 103 735 | A1 | 9/2017 | |
| DE | 10 2017 107 893 | A1 | 10/2018 | |
| EP | 3 388 645 | A1 | 10/2018 | |
| WO | WO-2009106373 | A1 * | 9/2009 | F01N 3/2066 |

OTHER PUBLICATIONS

International Search Report (PCT/ISA/210) issued in PCT Application No. PCT/EP2019/053753 dated Apr. 9, 2019 with English translation (four (4) pages).

German-language Written Opinion (PCT/ISA/237) issued in PCT Application No. PCT/EP2019/053753 dated Apr. 9, 2019 (five (5) pages).

German-language Search Report issued in German Application No. 10 2018 203 225.4 dated Nov. 16, 2018 with partial English translation (13 pages).

Chinese-language Office Action issued in Chinese Application No. 201980008719.0 dated Jul. 5, 2021 with English translation (17 pages).

* cited by examiner

METHOD FOR OPERATING A PARTICULATE FILTER IN A VEHICLE, AND PARTICULATE FILTER FOR AN INTERNAL COMBUSTION ENGINE IN A VEHICLE

BACKGROUND AND SUMMARY OF THE INVENTION

The invention relates to a method for operating a particulate filter of a vehicle, in particular of a motor vehicle such as a passenger car. Moreover, the invention relates to a particulate filter for an internal combustion engine.

Particulate filters have already been used for a relatively long time for filtering particulates, in particular soot particulates, from exhaust gases of internal combustion engines of vehicles, which internal combustion engines are configured, in particular, as diesel engines. Particulate filters are also used for gasoline engines, however. With the introduction of laws which consider the emissions during practical driving operation (RDE—Real Driving Emissions), it is to be expected that vehicles which are operated by way of gasoline engines will also be generally equipped with particulate filters.

It has been discovered that, in its unused state which is also called the fresh state, the respective particulate filter does not yet have its full filtration efficiency. For example, in the case of a particulate filter which has not yet been used, the filtration efficiency can be such that merely approximately 50% of the particulates which are contained in the exhaust gas of the respective internal combustion engine of the vehicle are retained. The filtration efficiency which is also called the filtration rate can be increased by way of the input of soot or ash. Soot can burn off at a sufficient temperature and in the presence of oxygen. In contrast, ash remains in the particulate filter as far as possible over the service life.

The filtration efficiency is increased, however, over the engine running time. Above all, ash, that is to say combustion residues which come, for example, from burned engine oil, contributes to the increase in the filtration efficiency of the particulate filter. It requires some time, however, until a sufficient ash layer is formed on the walls of the filter body of the particulate filter, which ash layer increases the filtration efficiency of the particulate filter to a desirable extent. For example, in the case of a vehicle with an internal combustion engine which is operated as a gasoline engine, a driving distance of approximately 50 000 km can be necessary, in order to achieve a sufficient filtration efficiency.

It is an object of the present invention to develop a method and a particulate filter of the type mentioned at the outset, in such a way that the ash can be introduced into the filter body of the particulate filter in a particularly simple way.

In the case of the method according to the invention for operating a particulate filter of a vehicle, in particular a motor vehicle, through which particulate filter exhaust gas, in particular of an internal combustion engine, can flow, ash is introduced into a filter body of the particulate filter. In particular, during normal driving operation of the vehicle which is configured, for example, as a car, in particular as a passenger car, the filter body is used, in order to filter from the exhaust gas any particulates, in particular soot particulates, which are possibly contained in the exhaust gas. The targeted or artificial or desired introduction of ash into the filter body is also called preliminary ash production of the particulate filter. The preliminary ash production of the particulate filter is carried out, in order to increase its filtration efficiency (also called filtration rate) in a targeted manner, in particular in comparison with an unused state (also called fresh state) of the particulate filter which has not yet been subjected to the preliminary ash production in the unused state.

Therefore, the invention focuses on an early input of ash into the particulate filter, which input of ash ensures the filtration rate reaches a sufficiently high degree before the vehicle is delivered to the customer. Furthermore, it is conceivable for the preliminary ash production to be carried out within the context of a service or repair, within the context of which the particulate filter is installed for the first time on or in the vehicle.

In order for it then to be possible for the ash to be introduced into the filter body of the particulate filter in a particularly simple way, it is provided according to the invention that at least one ash former or at least one ash constituent part is arranged at least indirectly, in particular directly, on at least one carrier material upstream of the filter body in the flow direction of the exhaust gas. In other words, it is provided according to the invention that at least one ash element is arranged on and/or at and/or in at least one carrier material upstream of the filter body, at least one ash former or at least one ash constituent part being used as the ash element. The feature that the ash former is arranged at least indirectly, in particular directly, on the carrier material is to be understood to mean, in particular, that the ash former or the ash constituent part is arranged at least indirectly, in particular directly, on and/or at and/or in the at least one carrier material. The feature that the ash former or the ash constituent part is arranged directly on the carrier material is to be understood to mean, in particular, that the ash former or the ash constituent part makes contact with the carrier material directly. The feature that the ash former or the ash constituent part is arranged indirectly at or in and/or on the carrier material is to be understood to mean, in particular, that the ash former or the ash constituent part is arranged, in particular held, on the carrier material via at least one additional component.

Within the context of the method according to the invention, the ash is introduced into the filter body by the at least one ash former or the at least one ash constituent part being arranged on and/or at and/or in the at least one carrier material upstream of the filter body. The ash which is to be introduced into the particulate body is formed, for example, from the ash former or is provided by the ash former, in particular in such a way that the ash former is decomposed, that is to say, for example, is dispersed, by means of the exhaust gas which flows through the particulate filter and therefore flows onto and/or around the ash former. This is to be understood to mean, in particular, that the ash former is decomposed into a plurality of small constituent parts. As an alternative or in addition, it is conceivable that the ash former is burned, in particular by means of the exhaust gas, and provides the ash as a result. If, for example, the at least one ash constituent part is used, the ash constituent part itself forms at least part of the ash which is to be introduced into the particulate body, with the result that the ash is introduced into the particulate body by way of introduction of the ash constituent part. The carrier material and the ash former or the ash constituent part are first of all arranged upstream of the filter body, into which the ash is to be introduced, and preferably downstream of the at least one combustion chamber of the internal combustion engine of the vehicle which is equipped with the particulate filter, in relation to the flow direction of the exhaust gas which flows through the particulate filter. The ash former thereupon provides the ash, or the ash constituent part forms at least part of the ash, with the result that the ash is introduced into the filter body after the carrier material and the ash former or the ash constituent part have been arranged upstream of the filter body. As a result of the introduction of the ash into the filter body, the ash is deposited, for example, on respective surfaces of the respective wall regions of the filter body. In this way, the filter body can be provided with the ash in a particularly inexpensive way.

A combustion residue is produced, for example, by way of burning of the ash former, the combustion residue being the ash which is to be introduced into the filter body. This ash is introduced or input into the filter body of the particulate filter, for example, with the exhaust gas, as a result of which the filtration efficiency of the particulate filter is increased. This can take place in a simple way, since merely the carrier material with the ash former or with the ash constituent part is arranged upstream of the filter body and therefore, for example, on an inlet-side end side of the filter body. As a result, the ash can be introduced into the particulate filter, in particular into the filter body, with particularly low costs and particularly low complexity.

The carrier material is, for example, a non-combustible carrier material. This is to be understood to mean, in particular, that the carrier material can be configured in such a way that the carrier material does not yet burn at temperatures, at which the ash former or the ash constituent part burns, as a result of which the ash can be introduced into the filter body in a particularly simple and targeted manner. Moreover, it is possible that the carrier material can be configured in such a way that the carrier material burns at temperatures, at which the ash former or the ash constituent part does not yet burn, as a result of which the ash can be introduced into the filter body in a particularly simple and targeted manner.

Furthermore, it is conceivable that the ash former or the ash constituent part and the carrier material are formed from materials which are different than one another. For example, the ash is introduced into the filter body in such a way that the ash former or the ash constituent part is separated or detached from the carrier material. In particular, the ash constituent part or the ash former is detached thermally from the carrier material. To this end, in particular, the exhaust gas or its temperature is used. In order to introduce the ash into the filter body, for example, the abovementioned internal combustion engine of the vehicle which is equipped with the particulate filter is set in operation, with the result that the internal combustion engine provides the exhaust gas. The exhaust gas then flows through the particulate filter. Here, the exhaust gas is preferably at a temperature which is so high that the ash former is burned. As an alternative or in addition, the ash former or the ash constituent part is detached, for example, from carrier material by way of the high temperature of the exhaust gas.

A high filtration efficiency of the particulate filter can already be achieved immediately at the beginning of the service life of the particulate filter by way of the introduction of the ash into the filter body of the particulate filter. Accordingly, in particular at the operating start of the particulate filter, the internal combustion engine of the vehicle which is equipped with the particulate filter does not need to be operated or needs to be operated only to a relatively small extent in such a way that a formation of soot particulates is reduced as far as possible. The method can also be carried out particularly simply and therefore inexpensively as a result. Furthermore, potential savings with regard to components and/or apparatuses can be realized which are required for the introduction of the ash into the filter body of the particulate filter, and with regard to personnel costs, in particular for development.

At least one paper and/or at least one plastic can be used as the carrier material. A metal layer, for example, can be used as the ash former. As the carrier material, a paper which is provided with a metal layer as the ash former can be provided particularly simply and inexpensively and can be arranged upstream of the filter body, in particular on an inlet-side end side of the filter body. Furthermore, it is conceivable, as the ash former, for a slurry which contains metal and/or metal oxide to be arranged on the carrier material, in particular in the form of paper and/or plastic, in order to provide the ash.

The invention is based, in particular, on the finding that soot can burn off at a sufficiently high temperature and in the presence of oxygen. In contrast, ash remains largely in the particulate filter, in particular in the filter body, over a service life. The invention therefore focuses on an early input of ash into the filter body, the input of ash ensuring the filtration efficiency (also called filtration rate) at a sufficiently high extent, in particular before the vehicle leaves the factory and is delivered to customers. The method according to the invention which can be used within the context of the production of the vehicle or in the case of a replacement or in the case of retrofitting of the particulate filter, in particular in repair shops, is based on the fact, in particular, that the ash former is burned, in particular by means of the exhaust gas, or the at least one ash former which directly forms at least part of the ash is input directly into the filter body. This means that the ash former and the ash constituent part differ from one another, in particular, by virtue of the fact that the ash constituent part per se already forms part of the ash which is to be introduced into the filter body. In contrast, the ash former per se does not yet form the ash, but rather the ash former is burned, in particular by means of the exhaust gas, and, as a result, provides the ash which is to be introduced into the filter body. Once again in other words, in order to form the ash which is to be introduced into the filter body, the ash constituent part is burned. This results in combustion residues of the ash constituent part, these combustion residues forming the ash which is to be introduced into the filter body. Finally, the combustion residues or the ash are/is introduced into the filter body. The ash constituent part does not have to be burned, however, and is not burned, in order to provide the ash which is to be introduced into the filter body, but rather the ash constituent part per se forms at least part of the ash which is to be introduced into the filter body, without being burned. The ash former or the ash constituent part is positioned upstream of the filter body by means of the carrier material and therefore can be flowed onto and/or around by the exhaust gas. This means that, as a result of the positioning of the ash former or the ash constituent part upstream of the filter body, the ash former or the ash constituent part is exposed to the exhaust gas or an exhaust gas stream which is formed by way of the exhaust gas. As a result, for example, the ash former can be burned by means of the exhaust gas, and/or the ash former or the ash constituent part can be released and/or decomposed or dispersed from the carrier material, and/or the carrier material itself can be decomposed or dispersed and/or burned by means of the exhaust gas.

It can be ensured in a simple and therefore inexpensive way by means of the method according to the invention that the particulate filter already has a sufficiently high filtration rate in the case of delivery of the vehicle to a customer, with the result that it can be ensured at all times, even in the case of extreme driving maneuvers, that a sufficient quantity of particulates is filtered from the exhaust gas by means of the particulate filter, in order to reliably comply with the legal requirements. As a consequence, particularly low-emissions operation can already be ensured at the beginning of the service life of the vehicle, even in the case of extreme driving maneuvers. The invention is a substantial enabler for ensuring the licensing capability in the case of the strict RDE emissions legislation.

It has been shown to be particularly advantageous if a catalytically coated particulate filter is used as the particulate filter. Particularly low-emissions operation can be ensured as a result in an inexpensive way. This means that the particulate filter has at least one catalytically active coating. As a result, the installation space requirement of the particulate filter can be kept low, in order for it to be possible, for example, for an additional three-way catalytic converter to be installed. With increasing operation of the particulate filter which is flowed through by exhaust gas during its operation, an increasing quantity of particulates are deposited in the particulate filter, since the latter filters the particulates out of the exhaust gas. The quantity of soot particles which are deposited in the particulate filter is also called the loading of the particulate filter. The abovementioned regeneration of the particulate filter is to be understood to mean that the loading of the particulate filter is at least reduced. If the catalytically active coating of the particulate filter is then catalytically active for the regeneration of the particulate filter, the regeneration of the particulate filter is assisted by way of the catalytically active coating. Here, in particular, the coating can assist the active regeneration and/or the passive regeneration catalytically, the loading being at least reduced with the aid of oxygen within the context of the active regeneration. Within the context of the passive regeneration, in particular when the internal combustion engine is configured as a diesel engine, the loading can at least be reduced with the aid of nitrogen dioxide.

In order for it to be possible for the ash to be introduced into the filter body particularly simply and therefore inexpensively, it is provided in a further refinement of the invention that an organic material is used as the at least one carrier material.

In order for it to be possible for a sufficiently high quantity of ash to be introduced into the filter body in a particularly inexpensive way, it is provided in the case of a further embodiment of the invention that an ash former or an ash constituent part is used as the at least one carrier material. Therefore, the carrier material itself is used for the introduction of ash into the filter body, with the result that a particularly high quantity of ash can be introduced into the filter body in a simple way.

It has been shown to be particularly advantageous here if no further ash former or ash constituent part is used on, at or in the carrier material.

A further embodiment is distinguished by the fact that the carrier material is decomposed, that is to say, for example, is dispersed, by way of the exhaust gas, in particular by way of the temperature thereof. In other words, an, in particular thermal, decomposition or dispersal of the carrier material is brought about by way of the exhaust gas, in particular by way of the temperature thereof. If the carrier material itself is, for example, an ash constituent part, the decomposed or dispersed carrier material can be deposited in the filter body onto the latter or its wall regions, as a result of which a particularly high filter rate of the particulate filter can be realized in a simple way. Furthermore, in particular when the carrier material is an ash former, the decomposition or dispersal of the carrier material can be understood to mean that the carrier material is burned by means of the exhaust gas. This results in combustion residues of the carrier material, the combustion residues of the carrier material forming at least part of the ash which is to be introduced into the filter body. In particular, together with the first ash constituent part or with combustion residues of the first ash former, the combustion residues of the carrier material form the ash which is to be introduced into the filter body overall, as a result of which a particularly high quantity of ash can be introduced into the filter body in a particularly simple and inexpensive way.

It is provided in a further refinement of the invention that the carrier material is introduced or arranged in a positively locking and/or non-positive or adhesive (that is to say, for example, integrally joined) or loose manner in front of or on an end face of the particulate filter, in particular of the filter body. As a result, the ash can be introduced into the filter body in a particularly simple and inexpensive way.

In a further refinement of the invention, the at least one ash former or the ash constituent part is connected in a positively locking and/or non-positive or adhesive (that is to say, in particular, integrally joined by means of an adhesive) manner to the carrier material. As a result, the costs can be kept particularly low.

A further embodiment is distinguished by the fact that the at least one ash former or ash constituent part is situated or enclosed loosely in the carrier material. In particular, the ash former or the ash constituent part can then be conveyed or blown out of the carrier material by means of the exhaust gas, and can be conveyed, in particular blown, into the filter body. Here, for example, the ash former is burned by means of the exhaust gas.

In the case of a further advantageous embodiment of the invention, a spacing is produced by way of shaping of the carrier material or by way of spacer elements between the ash former or the ash constituent part and the carrier material on one side and the particulate filter, in particular filter body, on the other side, by means of which spacing disadvantages in the case of direct contact with the particulate filter, in particular with the filter body or a particulate filter end wall, are avoided, or advantages are achieved with regard to a distribution of the ash in the particulate filter, in particular in the filter body. In other words, for example, the carrier material and the ash former or the ash constituent part form one structural unit which is arranged at the abovementioned spacing from the particulate filter, in particular from the filter body. This spacing which is also called a distance between the structural unit and the particulate filter, in particular filter body, is produced by way of shaping of the carrier material or by way of spacer elements. A direct contact of the structural unit with the filter body can be avoided by way of this spacing of the structural unit from the particulate filter, in particular from the filter body, with the result that any disadvantages which possibly result therefrom can be avoided. As an alternative or in addition, the ash can be distributed particularly advantageously as a result of the spacing, and therefore can be introduced into the filter body in a simple way and particularly advantageously.

In a further refinement of the invention, the carrier material and/or the ash former or ash constituent part have/has at least two layers or a shape which provides at least one cavity for the introduction of the ash former or ash constituent part. In other words, the layers in each case partially delimit a cavity, or the shape has a cavity, the ash former or the ash constituent part being introduced into the cavity. Once again in other words, for example, the ash former or the ash constituent part is received in the cavity which is formed by way of the layers or the shape. As a result, the filter body can be provided with the ash in a particularly simple and inexpensive way.

In the case of a further, particularly advantageous embodiment of the invention, the ash former or the ash constituent part is printed onto the carrier material, as a result of which at least one printed layer of the ash former or of the ash constituent part is produced. The printing is preferably 3D printing, by means of which the ash constituent part or the ash former is printed onto the carrier material. As a result, the carrier material is provided with at least one printed layer which is formed by way of the ash former or by way of the ash constituent part. In this way, the above-described structural unit can be produced in a manner which is particularly favorable in terms of time and costs, with the result that the ash can be introduced into the filter body particularly inexpensively.

It has been shown to be particularly advantageous here if a locally different distribution of the ash former or the ash constituent part on the carrier material is produced in the at least one printed layer.

A further embodiment is distinguished by the fact that the ash former or the ash constituent part is formed from at least two different materials. In other words, the ash former or the ash constituent part has at least two materials which are different than one another. As an alternative or in addition, it is conceivable that a respective material, from which the ash former or the ash constituent part is formed, is applied and/or introduced in a locally different concentration onto and/or on and/or into the carrier material.

In a further refinement of the invention, the ash former and/or the ash constituent part and/or the carrier material are/is subsequently or previously pierced, needled or perforated, in order to increase the throughflow capability. For example, the ash former or the ash constituent part and/or the carrier material are pierced before they are arranged upstream of the filter body. By way of the piercing, needling or perforating, the ash former or the ash constituent part and/or the carrier material are/is provided with at least one or preferably with a plurality of through openings which can be flowed through by the exhaust gas. As a result, the exhaust gas back pressure can be kept particularly low.

A further embodiment is distinguished by the fact that metals, metal oxides or metal compounds are used as the ash former or as the ash constituent part, as a result of which ash can be introduced into the filter body particularly simply and inexpensively.

In the case of a further embodiment of the invention, within the context of manufacturing of the vehicle which is equipped with the particulate filter, the internal combustion engine of the vehicle is operated in such a way that conditions are set at least in the region of the ash former or the ash constituent part, which conditions are suitable for an input of the ash into the filter body and/or for a decomposition or dispersal of the carrier material. In particular, the conditions comprise a temperature, in particular a high temperature, of the exhaust gas which is such that the exhaust gas, in particular the temperature thereof, brings about a combustion of the ash former and/or a decomposition or dispersal of the carrier material and/or, when, in particular, the carrier material is an ash former, a combustion of the carrier material and/or a release of the ash former or the ash constituent part from the carrier material. Therefore, for example, the abovementioned structural unit can be decomposed or dispersed as a result of the conditions, with the result that a sufficiently high quantity of ash can be introduced into the filter body in a particularly simple way.

In the case of a further embodiment of the invention, a temperature and/or a mass flow of the exhaust gas of the internal combustion engine of the vehicle which is equipped with the particulate filter, which exhaust gas flows through the particulate filter and in the process, in particular, through the filter body, are/is set in such a way that the ash is deposited at least predominantly on at least one wall of the filter body. As a result, a particularly high filter rate of the filter body can be realized in a simple way.

The internal combustion engine can be configured or can be capable of being operated or can be operated, for example, as a gasoline engine. Furthermore, it is conceivable that the internal combustion engine can be configured or can be capable of being operated or can be operated as a diesel engine. Furthermore, the internal combustion engine might be configured as a gas turbine, a steam engine or another internal combustion engine. The invention can therefore be used for every internal combustion engine.

A further embodiment is distinguished by the fact that metals, metal oxides or metal compounds are used as the ash former or the ash constituent part, or that the ash constituent part or the ash former comprises metals, metal oxides or metal compounds.

It is provided in a further refinement of the invention that alkali metals, alkali metal oxides, alkali metal hydroxides, alkali metal carbonates or alkali metal compounds are used as the ash former or the ash constituent part.

It is provided in the case of a further embodiment of the invention that alkali metals in compounds with silicon, known, for example, as water glass, are present as the ash former or the ash constituent part.

It is provided in a further refinement of the invention that alkaline earth metals, alkaline earth metal oxides, alkaline earth metal hydroxides, alkaline earth metal carbonates or alkaline earth metal compounds are used as the ash former or the ash constituent part.

A further embodiment is distinguished by the fact that magnesium, magnesium oxide, magnesium carbonate, magnesium hydroxide or magnesium compounds are used as the ash former or the ash constituent part.

Finally, it has been shown to be advantageous if calcium, calcium oxide, calcium carbonate, calcium hydroxide or calcium compounds are used as the ash former or the ash constituent part.

The invention also comprises a particulate filter for an internal combustion engine of a vehicle, with a filter body, through or around which exhaust gas of the internal combustion engine can flow, for filtering particulates which are possibly contained in the exhaust gas, in particular soot particles.

In order for it then to be possible for ash to be introduced into the filter body of the particulate filter in a particularly simple way, it is provided according to the invention that at least one ash former or at least one ash constituent part is arranged at least indirectly on at least one carrier material upstream of the filter body in the flow direction of the exhaust gas. Advantages and advantageous refinements of the method according to the invention are to be considered to be advantages and advantageous refinements of the exhaust gas section according to the invention, and vice versa.

Further details of the invention result from the following description of preferred exemplary embodiments with the associated drawings.

BRIEF DESCRIPTION OF THE DRAWINGS

In the figures, identical or functionally identical elements are provided with identical designations.

DETAILED DESCRIPTION OF THE DRAWINGS

Figure 1:
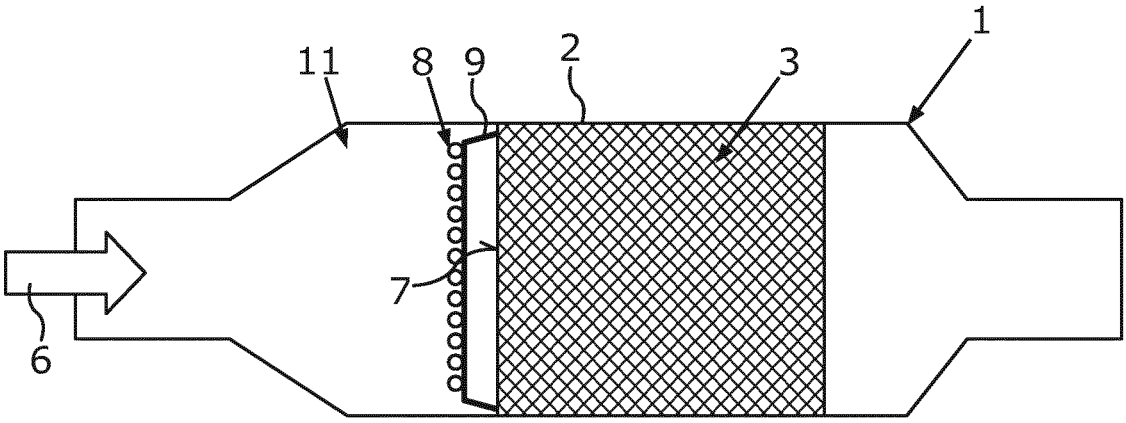
FIG. 1 shows a diagrammatic sectional view of a particulate filter according to the invention in accordance with a first embodiment for a vehicle, in particular for an internal combustion engine of a vehicle, a method according to the invention in accordance with a first embodiment being illustrated using FIG. 1.
Figure 10:
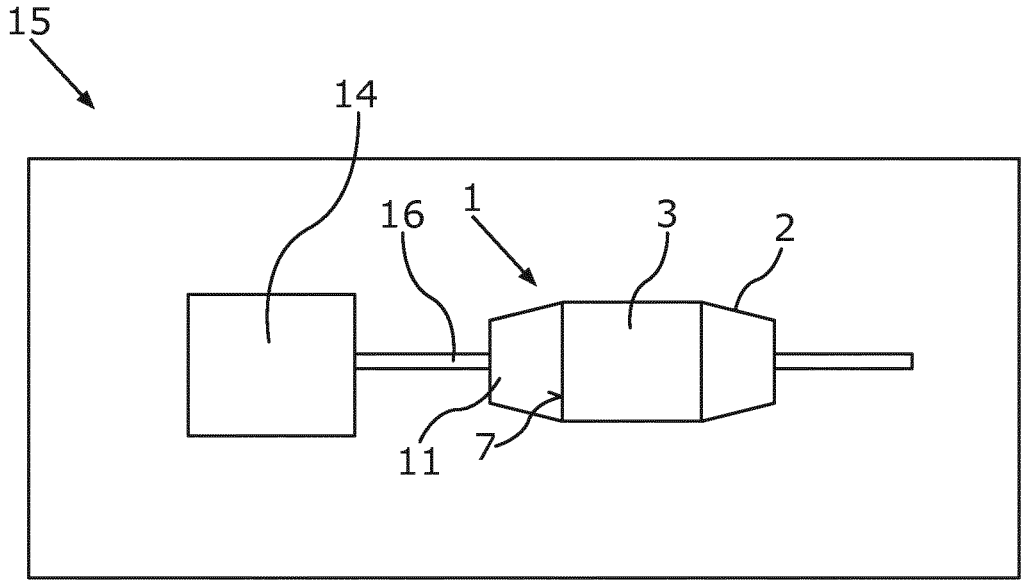
FIG. 10 shows a diagrammatic illustration of the vehicle which is configured as a motor vehicle and is equipped with the particulate filter and an internal combustion engine.

FIG. 1 shows a diagrammatic sectional view of a particulate filter 1 in accordance with a first embodiment of a vehicle which is configured as a motor vehicle. In particular, the vehicle is configured as a car and preferably here as a passenger car. The vehicle is shown diagrammatically in FIG. 10 and is denoted by 15 there. The vehicle 15 is equipped with the particulate filter 1 and with an internal combustion engine 14 which is preferably configured as a gasoline engine or is operated as a gasoline engine. As an alternative, the internal combustion engine 14 can be a diesel engine or else another internal combustion engine. The internal combustion engine 14 has at least one or more combustion chambers which are configured, for example, as cylinders. During combustion operation of the internal combustion engine 14, the respective combustion chamber is supplied at least with air and fuel, in particular liquid fuel, with the result that a fuel/air mixture is produced in the respective combustion chamber. The fuel/air mixture is burned, which results in the exhaust gas of the internal combustion engine 14. This means that, during combustion operation, exhaust gas which is provided by the internal combustion engine 14 is produced in the internal combustion engine 14, in particular in the respective combustion chamber. Here, an exhaust gas section 16 is provided, by means of which the exhaust gas is discharged from the respective combustion chamber. Therefore, the exhaust gas section 16 can be flowed through by the exhaust gas, or the exhaust gas section 16 is flowed through by the exhaust gas during combustion operation. Here, the particulate filter 1 is arranged in the exhaust gas section 16 and can be flowed through by the exhaust gas. By means of the particulate filter 1, particulates which are possibly contained in the exhaust gas, in particular soot particulates, are filtered at least partially from the exhaust gas, by the particulates from the exhaust gas which flows through the particulate filter 1 being deposited onto the particulate filter 1, in particular in its interior. As the service life increases, a quantity of particulates deposited in the particulate filter 1 increases, this quantity of particulates also being called loading of the particulate filter 1. In order to at least reduce the loading of the particulate filter 1, the particulate filter 1 is subjected to a regeneration. This regeneration is also called a filter regeneration.

The particulate filter 1 comprises a housing 2, in which a filter body 3 is arranged, through which the exhaust gas can flow. The filter body 3 is, for example, a structural element which is configured separately from the housing 2, and is arranged in the housing 2 here. The filter body 3 has a multiplicity of ducts and/or throughflow openings (cannot be seen in greater detail in the figures) which are flowed through by the exhaust gas during combustion operation. A flow direction of the exhaust gas through the particulate filter 1 is illustrated in FIG. 1 by way of an arrow 6, the exhaust gas flowing along or in the flow direction through the particulate filter 1.

In order for it then to be possible for a particularly high filtration rate or filtration efficiency of the particulate filter 1 to be realized at a particularly early time, a method for operating the particulate filter 1 is carried out. In the case of the method, ash is introduced into the filter body 3 in a targeted manner. In order for it to be possible here for the ash to be introduced into the filter body in a particularly simple and therefore inexpensive way, at least one ash element 8 is arranged at least indirectly, in particular directly, on at least one carrier material 9 upstream of the filter body 3 in the flow direction of the exhaust gas. Here, the ash element 8 and the carrier element 9 are arranged in the housing 2 and in the process upstream of the filter body 3, at least the ash element 8, for example, being spaced apart from the filter body 3, in particular at least in the flow direction of the exhaust gas. Within the context of the abovementioned method, it is therefore provided that the at least one ash element 8 is arranged at least indirectly on the at least one carrier material 9 upstream of the filter body 3 in relation to the flow direction of the exhaust gas which flows through the particulate filter 1.

The at least one ash element 8 can be, for example, at least one ash former, from which the ash which is to be introduced into the filter body 3 is formed, in particular, in such a way that the ash former is burned by way of the exhaust gas, in particular by way of the temperature thereof. As a result, combustion residues are produced from the ash former, the combustion residues of the ash former being the ash. This ash is then introduced into the filter body 3, in particular by virtue of the fact that the exhaust gas entrains the combustion residues, that is to say the ash, and therefore transports them into the filter body 3. Furthermore, it is conceivable that the at least one ash element 8 is at least one ash constituent part. The ash constituent part is per se ash and therefore forms per se at least part of the ash which is to be introduced or is introduced into the filter body 3. In other words, the ash constituent part forms at least part of the ash, without the ash constituent part being burned. The ash element 8 and the carrier material 9 are in each case solid components. This means that the ash element 8 and the carrier material 9 have a solid physical state while they are positioned or arranged upstream of the filter body 3 in the flow direction of the exhaust gas which flows through the particulate filter 1. In the case of the first embodiment, the components, that is to say the ash element 8 and the carrier material 9, are connected to one another, for example, or are held on one another. In particular, it is conceivable that the ash element 8 is arranged on and/or in the carrier material 9, in particular in a cavity of the carrier material 9.

The ash element 8 and the carrier material 9 form, for example, a structural unit which is arranged, for example, overall in the solid physical state in the housing 2 and in the process upstream of the filter body 3. In the case of the first embodiment, the structural unit and therefore the ash element 8 and the carrier material 9 are arranged upstream on an inlet-side (in relation to the flow direction) end side 7 of the filter body 3, the structural unit being arranged or supported, in particular via the carrier material 9, for example at least indirectly, in particular directly, on the end side 7 of the filter body 3. The structural unit can be formed, for example, by way of a wad or by way of a plurality of wads, it being possible for the respective wad to be formed from metal paper. This means that the respective wad has, for example, paper as the carrier material 9 and metal as the ash element 8, in particular when the ash element 8 is configured as an ash former. The metal is therefore arranged on or at the paper and is balled with the latter and shaped to form the respective wad.

In the case of the first embodiment, the ash element 8 and the carrier material 9 are components which are configured separately from one another and are connected to one another, the ash element 8 being arranged and held in the process on the carrier material. In particular, the ash element 8 is arranged and held on the carrier material 9, in particular on a surface of the carrier material 9. The carrier material 9 is, for example, a material which is different than an ash former and an ash constituent part.

The structural unit and therefore the ash element 8 and the carrier material 9 can be arranged very simply in an inlet region 11 of the housing 2, the structural unit being arranged in the present case downstream of a section of the inlet region 11, which section widens in a funnel-shaped manner. In particular, the structural unit is arranged in a further section of the inlet region 11, it being possible, for example, for the further section to have the shape of a straight circular cylinder at least on the inner circumferential side. For example, in particular in a state in which the ash element 8 is arranged on the carrier material 9 and therefore forms the structural unit, the ash element 8 and the carrier material 9 can be introduced via a front-side access opening of the particulate filter 1 into the housing 2, in particular into the inlet region 11, in particular can be stuffed into the housing 2 or into the inlet region 11. Even if a plurality of structural units such as wads are arranged in the inlet region 11 for example, the filter body 3 can nevertheless be flowed around or through satisfactorily by exhaust gas. At least one aid can be attached to the structural unit, in particular to the ash element 8 and/or to the carrier material 9, which aid ensures advantageous adhering of the structural unit to the end side 7 of the filter body 3. This is the case, in particular, when the structural unit is of substantially flat configuration and bears substantially flatly against the end side 7.

Metals, metal oxides or metal compounds can be used as the ash element 8, in particular as the ash former or ash constituent part. In particular, the ash element 8 can comprise a slurry which can comprise metal and/or oxides, in particular metal oxides. A metal slurry of this type can be arranged with very low effort upstream of the filter body 3 and can be applied, for example, to the end side 7. Furthermore, it is conceivable to apply a metal suspension of the ash element 8 to the carrier material 9, which metal suspension can be formed, for example, on paper and/or plastic. For example, by way of setting of operation of the internal combustion engine 14, conditions can be set which bring it about that the ash which is provided by the ash element 8 is deposited at least predominantly in or onto the filter body 3, in particular on the walls of the filter body 3. This can be achieved by a suitable and sufficiently high temperature and a suitable mass flow of the exhaust gas being set in the particulate filter 1 and in the process at least in the region of the structural unit by way of corresponding operation of the internal combustion engine 14 which is arranged upstream of the particulate filter 1. For example, in the case of the throughflow of the filter body 3, the particulates which are contained in the exhaust gas are retained by means of the filter body 3.

The introduction of the ash into the filter body 3 is preferably carried out in the case of a first use of the internal combustion engine 14. In the case of this first use, the internal combustion engine 14 is operated in its combustion operation. By way of corresponding operation of the internal combustion engine 14, it is preferably ensured during production of the vehicle 15 that conditions which are suitable for an input of the ash into the filter body 3 prevail in the inlet region 11 and therefore at least in the region of the structural unit. As a result of the conditions, for example, the ash element 8 is released from the carrier material 9 and/or the ash element 8 is burned, in particular, when the ash element 8 is configured as an ash former, and/or the ash element 8 is decomposed or dispersed, as a result of which the ash can be distributed in a fine manner, for example. Furthermore, it is conceivable that the carrier material 9 is decomposed or dispersed by way of the conditions, in particular when a further ash former or at least one further ash constituent part is used as the carrier material 9. If, for example, the abovementioned further ash former is used as the carrier material 9, it can be provided that the further ash former is burned by way of the conditions, as a result of which the ash which is to be introduced into the filter body 3 is formed.

Figure 2:
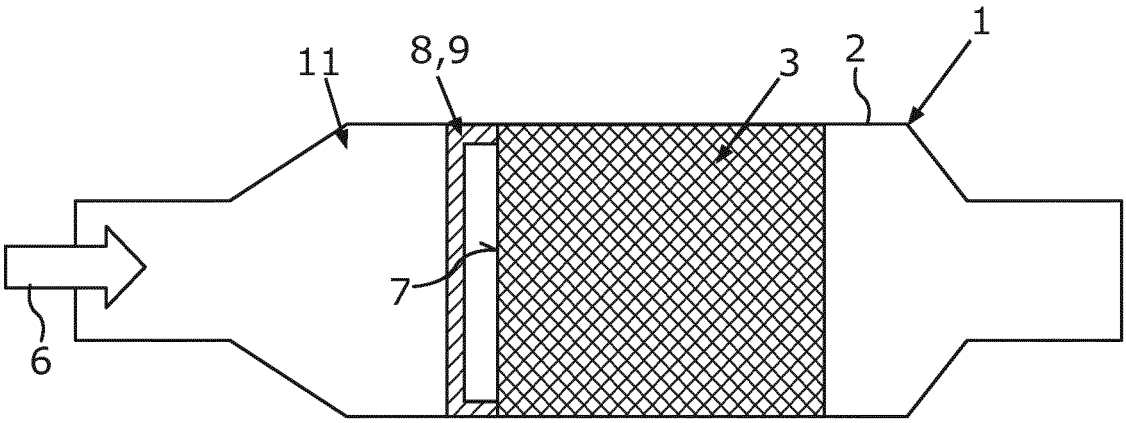
FIG. 2 shows a diagrammatic sectional view of the particulate filter according to the invention in accordance with a second embodiment, the method according to the invention in accordance with a second embodiment being illustrated using FIG. 2.

FIG. 2 shows a second embodiment. In the case of the second embodiment, the carrier material 9 which is solid, in particular, or is present in the solid physical state is configured as one or the ash element 8. Furthermore, it is conceivable that the ash element 8 is added to the carrier material 9.

Figure 3:
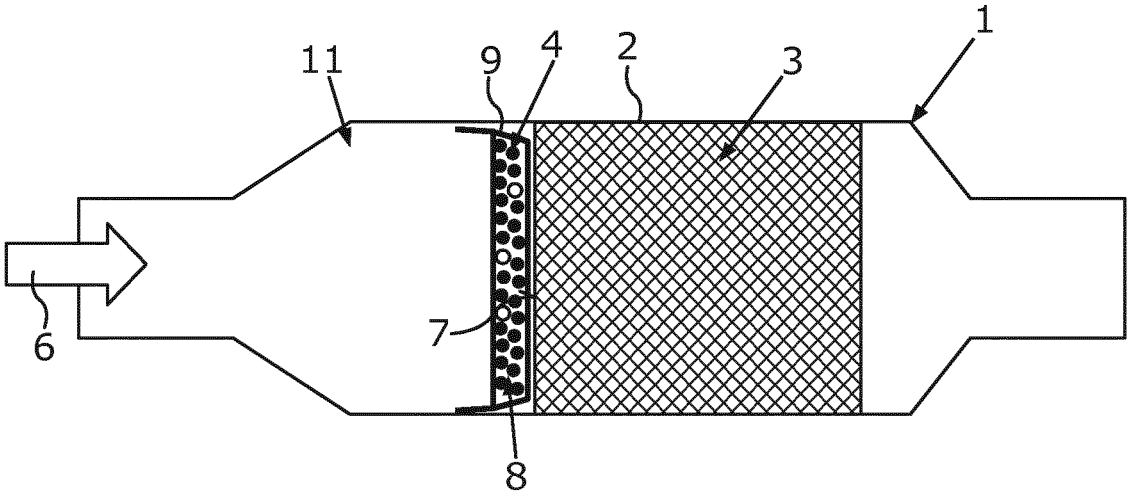
FIG. 3 shows a diagrammatic sectional view of the particulate filter according to the invention in accordance with a third embodiment, the method according to the invention in accordance with a third embodiment being illustrated using FIG. 3.

FIG. 3 shows a third embodiment. In the case of the third embodiment, the ash element 8 and the carrier material 9 are configured as components which are configured separately from one another, the ash element 8 being received or enclosed in the carrier material 9, in particular over the full circumference. The ash element 8 can be configured or present, in particular, as granular material. The carrier material 9 which can be configured as a carrier forms at least one cavity 4, in which the ash element 8 is received, in particular completely. For example, at least one opening of the carrier material 9 is configured, for example, by way of heat, in particular of the exhaust gas, it being possible for the ash element 8 or the ash to flow, for example, via this opening out of the cavity 4 and to then pass into the particulate filter.

Figure 4:
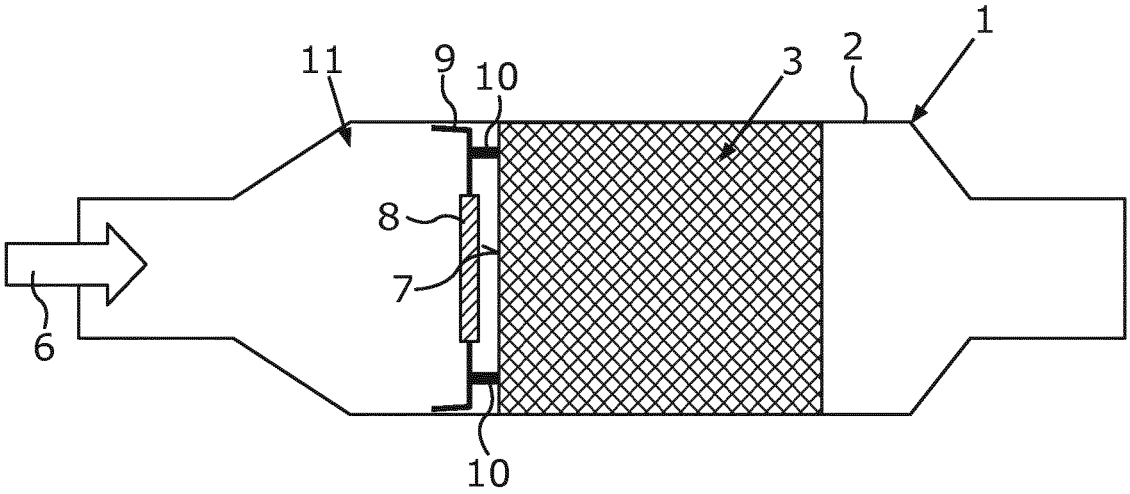
FIG. 4 shows a diagrammatic sectional view of the particulate filter according to the invention in accordance with a fourth embodiment, the method according to the invention in accordance with a fourth embodiment being illustrated using FIG. 4.

FIG. 4 shows a fourth embodiment. In the case of the fourth embodiment, the ash element 8 is held on the carrier material 9, it being possible for the ash element 8 and the carrier material 9 to be configured as components which are configured separately from one another and are connected to one another. Here, at least one or more spacer elements 10 is/are provided. The spacer element 10 is supported, for example, at least indirectly, in particular directly, on the filter body 3 and in the process on the end side 7 which is also called an end face. By means of the spacer element 10, the ash element 8 is spaced apart from the filter body 3, in particular from the end side 7, in particular at least in the flow direction of the exhaust gas. For example, via the spacer element 10, the carrier material 9 is supported at least indirectly, in particular directly, on the filter body 3, in particular on the end side 7. The end side 7 runs, for example, in a plane which extends at least substantially perpendicularly with respect to the flow direction of the exhaust gas. In the present case, for example, the respective spacer element 10 is formed by way of the carrier material 9. The ash element 8 is preferably spaced apart completely from the filter body 3, with the result that the ash element 8 does not make contact with the filter body 3. For example, the ash element 8 is configured in one piece. As an alternative or in addition, precisely one ash element is preferably provided in the form of the ash element 8.

Figure 5:
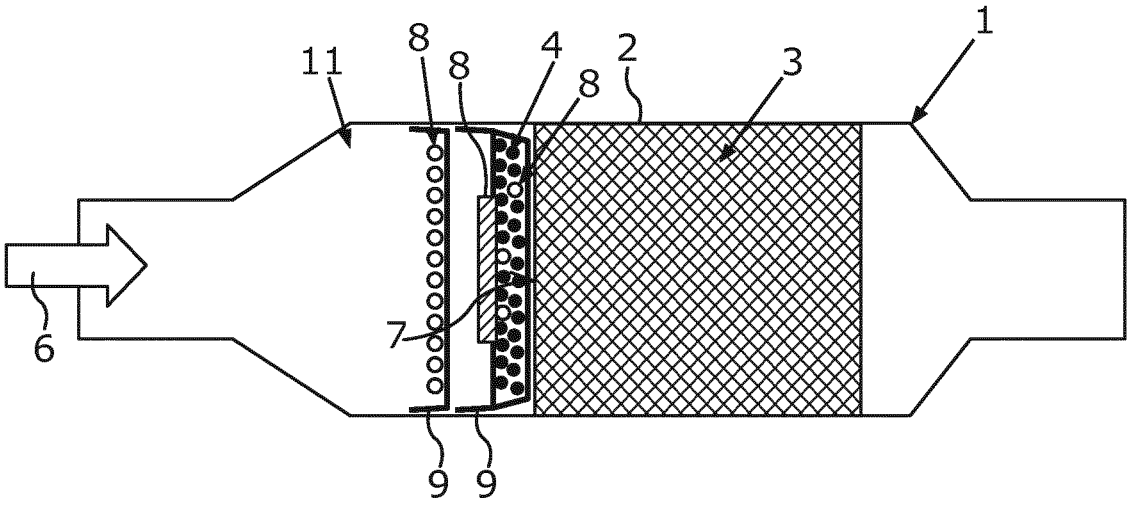
FIG. 5 shows a diagrammatic sectional view of the particulate filter according to the invention in accordance with a fifth embodiment, the method according to the invention in accordance with a fifth embodiment being illustrated using FIG. 5.

FIG. 5 shows a fifth embodiment. The fifth embodiment is, for example, a combination of the first, third and fourth embodiment. The structural unit and/or the carrier material 9 and/or the ash element 8 can be connected, for example, in a positively locking and/or non-positive and/or integrally joined manner to the filter body 3, in particular to the end side 7.

Figure 6:
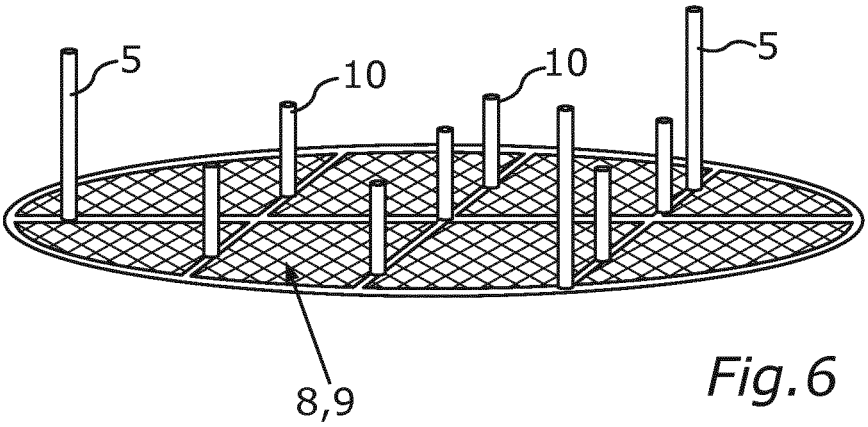
FIG. 6 shows a diagrammatic perspective view of a carrier material of the particulate filter according to the invention in accordance with a sixth embodiment.

FIG. 6 shows the carrier material 9 in accordance with a sixth embodiment, in the case of which the carrier material 9 can be one or the ash element 8, or else the ash element 8 is added to the carrier material 9. In the case of the sixth embodiment, connecting elements 5 are provided which are formed, for example, by way of the carrier material 9 and/or the ash element 8. By means of the connecting elements 5, the carrier material 9 or the ash element 8 is connected, for example, in a positively locking and/or non-positive manner to the filter body 3. Furthermore, the connecting elements 5 can serve as spacer elements for spacing the ash element 8 apart from the filter body 3, in particular from the end side 7.

The particulate filter 1, in particular the filter body 3, has, for example, a catalytically active coating. In particular, at least one part region of the filter body 3 is provided with the catalytically active coating. The catalytically active coating acts, for example, as an oxidation catalytic converter, with the result that the particulate filter 1 is configured as a catalytically active particulate filter.

Figure 7:
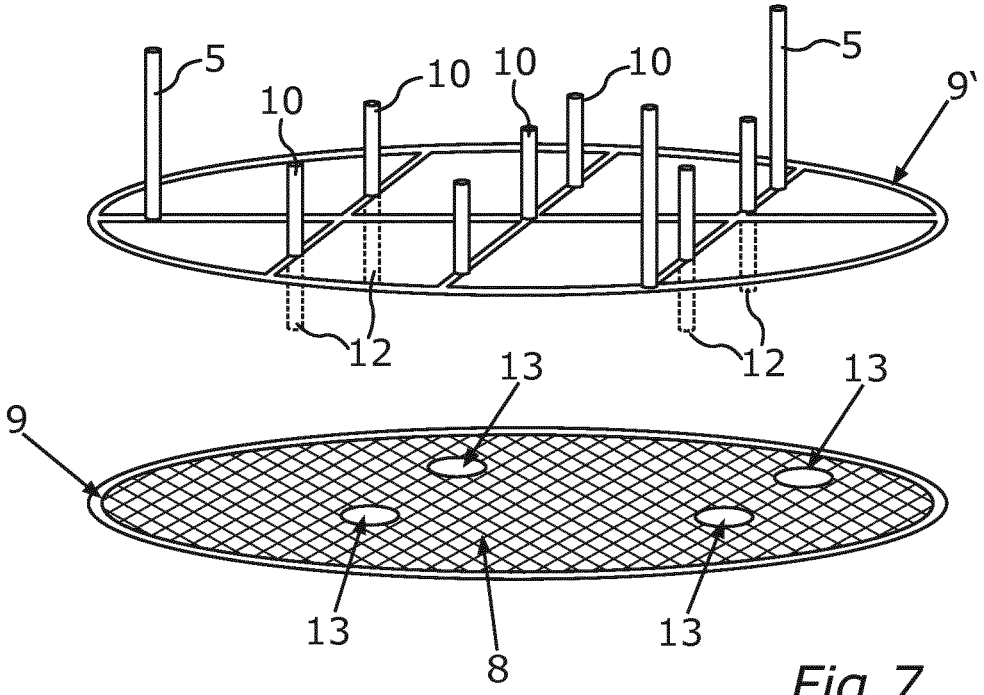
FIG. 7 shows a diagrammatic exploded view of a carrier material of the particulate filter according to the invention in accordance with a seventh embodiment.

FIG. 7 shows a seventh embodiment. Here, a carrier material 9' does not have an ash element, that is to say does not have an ash former or an ash constituent part. The carrier material 9 has, for example, a carrier and one or the ash element 8, the carrier material 9 with the ash element 8 and the carrier material 9' being configured as structural elements which are configured separately from one another and are connected to one another. To this end, the first connecting parts 12 are provided which are formed, for example, by way of the carrier material 9'. Moreover, the second connecting parts 13 are provided which are formed, for example, by way of the carrier material 9, in particular its carrier, and/or by way of the ash element 8. By means of the connecting parts 12 and 13, the carrier material 9' and the carrier material 9 with the ash element 8 are connected to one another. This connection via the connecting parts 12 and 13 can be, for example, non-positive and/or positively locking and/or integrally joined. In particular, the connection of the connecting parts 12 and 13 can be adhesive.

Figure 8:
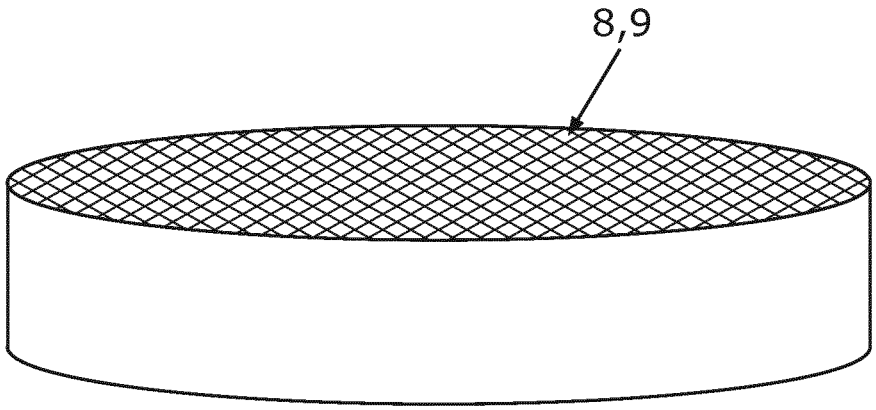
FIG. 8 shows a diagrammatic perspective view of a carrier material of the particulate filter according to the invention in accordance with an eighth embodiment.

FIG. 8 shows an eighth embodiment, in the case of which the carrier material 9 is one or the ash element 8, or else the ash element 8 is added to the carrier material 9.

Figure 9:
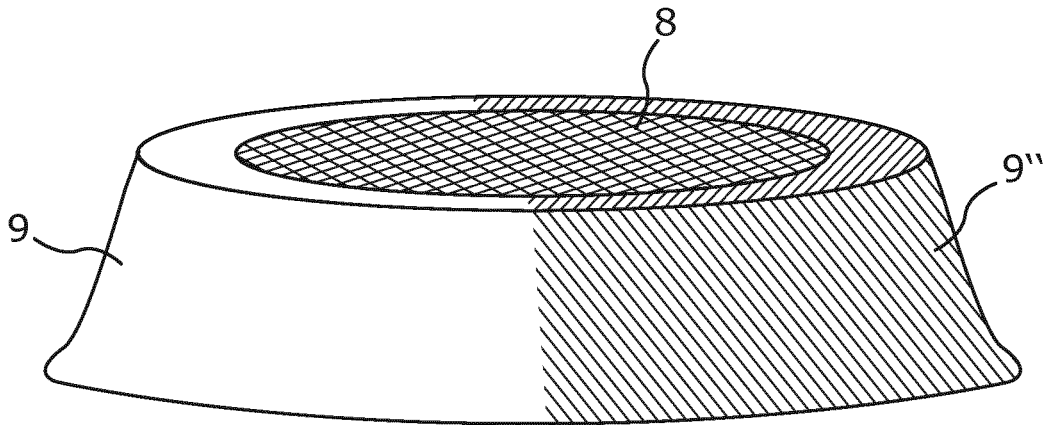
FIG. 9 shows a diagrammatic perspective view of a carrier material of the particulate filter according to the invention in accordance with a ninth embodiment.

Finally, FIG. 9 shows a ninth embodiment. Here, the carrier material 9 is free from an ash element, with the result that the carrier material 9 does not have an ash former or an ash constituent part. Here, the ash element 8 is arranged or held partially on the carrier material 9. A carrier material 9", however, is an ash element or comprises an ash element, the carrier materials 9 and 9" being connected to one another. Here, the ash element 8 is partially also arranged or held on the carrier material 9".

LIST OF DESIGNATIONS

1 Particulate filter
2 Housing
3 Filter body
4 Cavity
5 Connecting element
6 Arrow
7 End side
8 Ash element
9, 9', 9" Carrier material
11 Inlet region
12 Connecting part
13 Connecting part
14 Internal combustion engine
15 Vehicle
16 Exhaust gas section

What is claimed is:

1. A method of operating a particulate filter of a vehicle, through which particulate filter exhaust gas can flow, the method comprising:

arranging at least one ash former or at least one ash constituent part at least indirectly on at least one carrier material upstream of a filter body of the particulate filter in a flow direction of the exhaust gas; and introducing ash into the filter body of the particulate filter via the at least one ash former or the at least one ash constituent part, wherein at least one of the carrier material and the ash former or the ash constituent part have two layers which provide at least one cavity from which the ash former or the ash constituent part is releasable into the filter body of the particulate filter.

2. The method according to claim 1, wherein the particulate filter is a catalytically coated particulate filter.

3. The method according to claim 1, wherein the at least one carrier material is an organic material.

4. The method according to claim 1, wherein the at least one carrier material is an ash former or an ash constituent part.

5. The method according to claim 4, wherein no further ash former or ash constituent part is on, at or in the carrier material.

6. The method according to claim 4, wherein
the carrier material is decomposed by way of the exhaust gas.

7. The method according to claim 1, wherein
the carrier material is introduced in a positively locking, non-positive, adhesive, or loose manner in front of or on an end face of the particulate filter.

8. The method according to claim 1, wherein
the at least one ash former or ash constituent part is connected in a positively locking, non-positive, or adhesive manner to the carrier material.

9. The method according to claim 1, wherein
the at least one ash former or ash constituent part is arranged or enclosed loosely in the carrier material.

10. The method according to claim 1, wherein
the carrier material is configured, or spacer elements are provided, such that a spacing exists between the ash former or ash constituent part and the carrier material on one side of the spacing, and the filter body on the other side of the spacing.

11. The method according to claim 1, wherein
the ash former or the ash constituent part is printed onto the carrier material by way of at least one printed layer.

12. The method according claim 11, wherein
a locally different distribution of the ash former or the ash constituent part on the carrier material is produced in the at least one printed layer.

13. The method according to claim 1, wherein
the ash former or the ash constituent part is formed from at least two different materials, and
a respective material, from which the ash former or the ash constituent part is formed, is applied in a locally different concentration onto, on, or in the carrier material.

14. The method according to claim 1, wherein
the ash former, the ash constituent part, or the carrier material is pierced, needled or perforated.

15. The method according to claim 1, wherein
the ash former or the ash constituent part include metals, metal oxides or metal compounds.

16. The method according to claim 1, wherein
the ash former or the ash constituent part include alkali metals, alkali metal oxides, alkali metal hydroxides, alkali metal carbonates or alkali metal compounds.

17. The method according to claim 1, wherein
the ash former or the ash constituent part include alkali metals in compounds with silicon.

18. The method according to claim 1, wherein
the ash former or the ash constituent part include alkaline earth metals, alkaline earth metal oxides, alkaline earth metal hydroxides, alkaline earth metal carbonates or alkaline earth metal compounds.

19. The method according to claim 1, wherein
the ash former or the ash constituent part include magnesium, magnesium oxide, magnesium carbonate, magnesium hydroxide or magnesium compounds.

20. The method according to claim 1, wherein
the ash former or the ash constituent part include calcium, calcium oxide, calcium carbonate, calcium hydroxide or calcium compounds.

21. The method according to claim 1, further comprising the act of:
operating an internal combustion engine of the vehicle upstream of the particulate filter at operating conditions which result in, at least in a region of the ash former or the ash constituent part, an input of ash into the filter body and/or for a decomposition of the carrier material.

22. The method according to claim 21, wherein
the operating conditions include setting a temperature and/or a mass flow of the exhaust gas of the internal combustion engine such that the ash is deposited at least predominantly on at least one wall of the filter body.

23. The method according to claim 1, wherein
the internal combustion engine is a gasoline engine.

24. A particulate filter for an internal combustion engine of a vehicle, comprising:
a filter body for filtering particulates, which filter body can be flowed through by exhaust gas of the internal combustion engine; and
at least one ash former or at least one ash constituent part arranged at least indirectly on at least one carrier material upstream of the filter body in a flow direction of the exhaust gas,
wherein at least one of the carrier material and the ash former or the ash constituent part have two layers which provide at least one cavity from which the ash former or the ash constituent part is releasable into the filter body of the particulate filter.

* * * * *